United States Patent [19]

Evankow, Jr.

[11] Patent Number: 4,602,190

[45] Date of Patent: Jul. 22, 1986

[54] SEMICONDUCTOR MULTIPACTOR DEVICE

[75] Inventor: Joseph D. Evankow, Jr., Bernardsville, N.J.

[73] Assignee: The United States of America as represented by the Secretary of the Army, Washington, D.C.

[21] Appl. No.: 612,524

[22] Filed: May 21, 1984

[51] Int. Cl.[4] ..... H01J 7/46

[52] U.S. Cl. ..... 315/39.63; 315/5.11; 315/5.12; 315/39

[58] Field of Search ..... 315/5.11, 5.12, 39.63, 315/39

[56] References Cited

U.S. PATENT DOCUMENTS

| | | | |
|---|---|---|---|
| 3,036,234 | 5/1962 | Dacey | 315/39.63 |
| 3,244,922 | 4/1966 | Wolfgang | 313/534 |
| 3,312,857 | 4/1967 | Farnsworth | 315/5 |
| 3,967,155 | 6/1976 | Chavanat et al. | 315/5.12 |

FOREIGN PATENT DOCUMENTS

| | | | |
|---|---|---|---|
| 577278 | 5/1946 | United Kingdom | 315/5.11 |

*Primary Examiner*—Harold Dixon

*Attorney, Agent, or Firm*—Anthony T. Lane; Jeremiah G. Murray; Robert A. Maikis

[57] ABSTRACT

The placement of one or a pair of suitably biased thin semiconductor epitaxial layers on the secondary emission surface of a multipactor device provides an improvement of devices which operate in accordance with the principle of multipactoring. A multipactor device is disclosed having a multipactor region comprised of at least one surface formed of one or more thin epitaxial semiconductor layers, the outer layer being of n-type semiconductor material consisting of, for example, gallium phosphide covered with cesium which provides an abundance of free electrons at the surface when biased in the forward direction. In one disclosed configuration the multipactor region is located in a section of waveguide while in another arrangement the region is located on the top of a post in a multipactor input cavity.

7 Claims, 5 Drawing Figures

FIG. 1
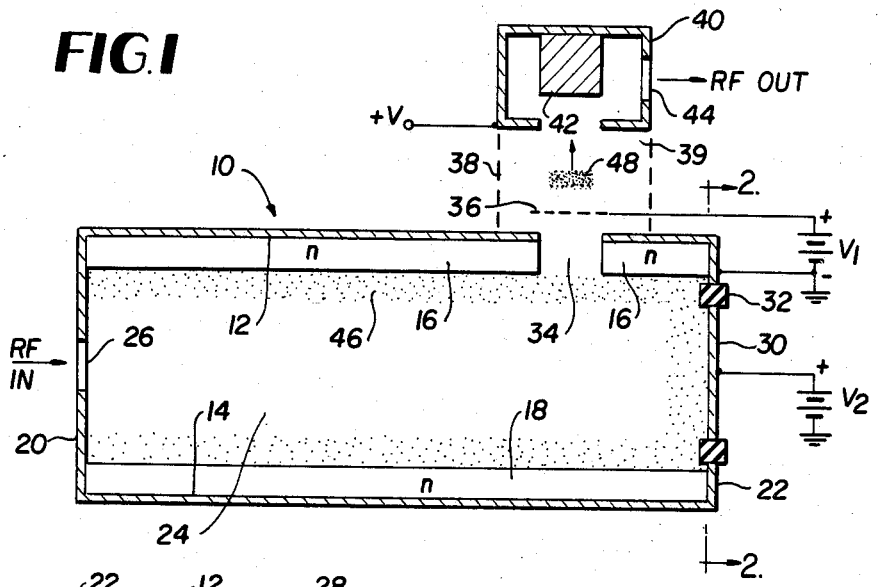
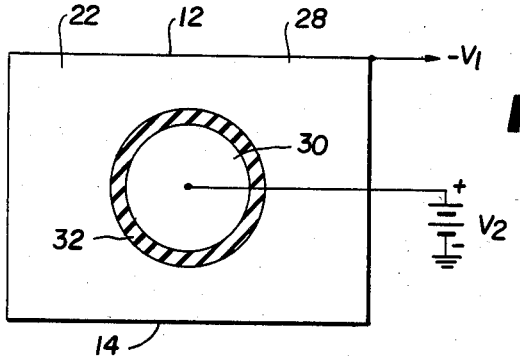
FIG. 2
FIG. 3
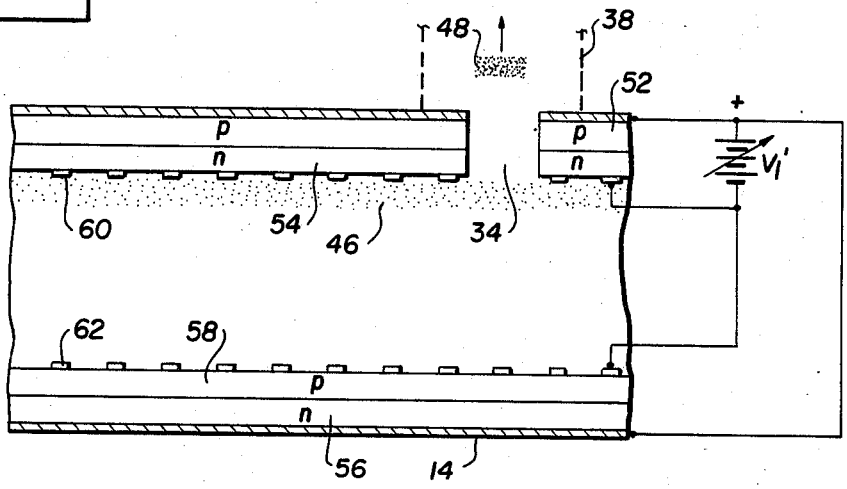
FIG. 4
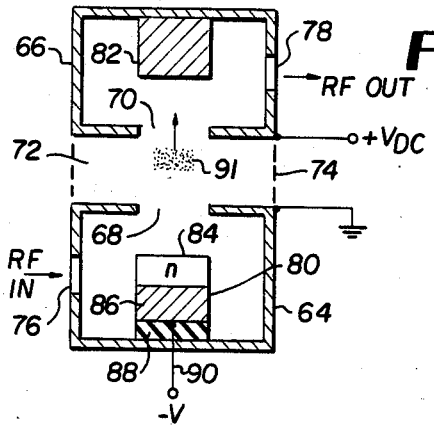
FIG. 5
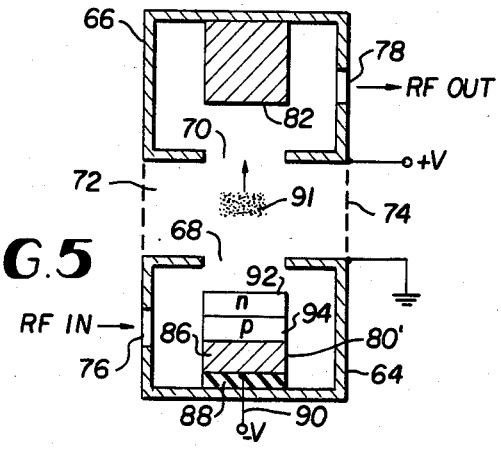

SEMICONDUCTOR MULTIPACTOR DEVICE

The invention described herein may be manufactured and used by or for the Government for governmental purposes without the payment of any royalties thereon or therefor.

CROSS REFERENCE TO RELATED APPLICATION

This application is related to U.S. Ser. No. 583,920 entitled, "Broadband Multipactor Device", filed in the name of Paul Fischer on Feb. 27, 1984.

FIELD OF THE INVENTION

This invention relates generally to high frequency electronic devices and more particularly to microwave or millimeter wave devices wherein a beam of bunched electrons is utilized in the generation of an amplified electrical signal.

The principle of multipactoring caused by secondary electron multiplier action is well known and occurs when the coefficient of secondary electron emission between opposed surfaces across which a cyclic voltage is maintained, exceeds unity. Furthermore, if one of the opposed surfaces includes an aperture or port, the electrons that are allowed to escape constitute a useful beam current. Additionally, due to the resonant nature of the multipactor process, the output beam will be bunched and thus a non-thermionic electron source becomes available for many signal applications such as amplification. One known microwave amplifier using multipaction to produce periodically bunched electrons is U.S. Pat. No. 3,312,857, issued to P.T. Farnsworth on Apr. 4, 1967. The invention there discloses an electron discharge device comprising a cavity having two spaced apart field defining and electron emitting surfaces with means for applying an alternating electromagnetic field spaced between the surfaces. The spacing between the surfaces and the amplitude and period of the field is such as to produce phase focusing of electrons in the space between the surfaces. One of the surfaces has an electron emitting aperture from which bunches of phase focused electrons are emitted. The device also includes means for accelerating and directing electron bunches periodically emitted from the aperture along a predetermined path as well as means for absorbing the kinetic energy from the bunches as they traverse a predetermined region in said path.

An RF activated, non thermionic electron gun employing the principle of multipactoring is also known and has been disclosed, for example, in an article entitled, "The Multipactor Electron Gun" by William J. Gallagher, which appeared in *The Proceedings Of The IEEE* of January, 1969, at pages 94–95.

The known prior art also includes a disclosure of a dynode structure coated with semiconductor secondary emissive material. Such a disclosure is included in U.S. Pat. No. 3,244,922, entitled, "Electron Multiplier Having Undulated Passage With Semiconductive Secondary Emissive Coating", which issued to L.G. Wolfgang, on Apr. 5, 1966.

SUMMARY

Accordingly, it is an object of the invention to provide an improved high frequency electronic device.

It is another object of the present invention to provide an improved electronic device operating in accordance with the secondary electron resonance phenomenon known as multipactor.

It is still another object of the present invention to provide an improvement in multipactor type devices for use with microwave or millimeter wave signals.

Briefly, the foregoing as well as other objects of the invention are provided by a multipactor device having a multipactor region comprised of at least one surface formed of one or more thin epitaxial semiconductor layers, the outer layer being of n-type semiconductor material consisting of, for example, gallium phosphide covered with cesium which provides an abundance of free electrons at the surface when biased in the forward direction. In one embodiment the multipactor region is located in a section of waveguide while in another embodiment the region is located on the top of a post in a multipactor input cavity.

BRIEF DESCRIPTION OF THE DRAWINGS

FIG. 1 is a longitudinal cross sectional view schematically illustrative of one embodiment of the invention;

FIG. 2 is a sectional view of the embodiment shown in FIG. 1 taken along the lines 2—2 thereof;

FIG. 3 is a fragmentary longitudinal cross sectional view schematically illustrative of a second embodiment of the invention;

FIG. 4 is a transverse sectional view schematically illustrative of a third embodiment of the invention; and FIG. 5 is a transverse cross sectional view schematically illustrative of a fourth embodiment of the invention.

DETAILED DESCRIPTION OF THE PREFERRED EMBODIMENTS

Referring now to the drawings and more particularly to FIGS. 1 and 2, shown thereat is a first embodiment of the invention which is configured in the form of an elongated RF transmission line 10 such as a section of rectangular waveguide and one having the inner surfaces of the broad top and bottom walls 12 and 14 supporting layers 16 and 18, respectively, of n-type semiconductor material which exhibits a relatively high secondary emission ratio. Typically, such a material comprises gallium phosphide (GaP) which is covered with a layer of cesium (Cs). Such a combination is known to have a secondary emission ratio of approximately 50.

Further as shown in FIG. 1, the ends of the waveguide section 10 are closed by end plate terminations 20, 22, for providing a structure, the interior region 24 of which can be evacuated to provide a vacuum type of operational environment. One end plate 20 includes an input window 26 for the coupling of an RF input field into the waveguide section 10. The other end plate 22 consists of two parts 28 and 30 which are separated by a ring 32 of insulating material. The purpose of this construction is for the application of two separate negative and positive DC voltages to the end sections 28 and 30 and as shown in FIGS. 1 and 2, from DC voltage sources $V_1$ and $V_2$ respectively. The negative voltage is coupled to end plate section 28 while a positive voltage is coupled to the circular end section 30.

An aperture or output port 34 is located toward the far end of the waveguide section 10 through the top wall 12 and the semiconductor layer 16. A grid structure 36 is located adjacent to the output port 34 outside of the waveguide structure 10 in an envelope which is shown schematically by reference numeral 38 and which is adapted to maintain the integrity of the vacuum inside of the waveguide structure 10. The envelope 38 is constructed to provide a drift space 39 between the output port 34 and an output circuit, shown for purposes of illustration, comprising a multipactor cavity 40 which has a positive +V acceleration voltage applied thereto. This voltage is more positive than the voltage applied to the grid 36, which in certain applications may be omitted entirely. The multipactor cavity, moreover, includes a metal post 42 and an RF output window 44. Such a configuration is well known to those skilled in the art.

As noted above, the secondary electron resonance phenomenon known as multipactor, occurs when the coefficient of secondary electron emission between two opposed surfaces across which a cycling voltage is maintained exceeds unity and furthermore, if one or more of the opposed surfaces is perforated, electrons will emerge therefrom in bunches. Accordingly, the negative voltage coupled to the rear wall section 28 is also applied to the n-type semiconductor material of the layers 16 and 18 which causes a forward bias which will yield an abundance of free electrons and forms a cloud at the surface of the semiconductor layer as shown by reference numeral 46. Because of the relatively high secondary emission ratio, multipactoring will be initiated at a relatively low RF input power and furthermore will be attracted to the positively biased end plate section 30. Thus the coupling of an RF field to the section of waveguide 10 through the input window 26 causes it to travel down the length of the waveguide whereupon multipactor action will commence and bunches of electrons 48 will be attracted through the grid 36 into the drift space 39. The electron bunches 48 will then traverse the drift space 39 to the multipactor output cavity 40.

A second embodiment of the invention is shown in FIG. 3 and is similar to the first embodiment shown in FIG. 1 with the exception now that the single layer of semiconductor material 16 is replaced by a two layer configuration comprised of two epitaxial layers, specifically an inner p-type semiconductor layer 52 and an outer n-type semiconductor layer 54 secured to the upper broadwall 12 of the waveguide section 10 and an inner n-type layer 56 and an outer epitaxial p-type layer 58 located on the lower broadwall 14 of the waveguide section 10. Both pairs of semiconductor layers 52, 54 and 56, 58 establish p-n junctions along the section of waveguide 10 which are biased by means of a variable DC source $V_1'$ and which has its positive terminal connected to the upper broadwall 12, while the negative terminal is connected to upper and lower grid structures 60 and 62, respectively affixed to the outer n and p semiconductor layers 54 and 58. In any event, the application of the bias voltage $V_1'$ will give rise to a secondary emission characteristic as previously described and multipactor action will commence when an RF wave is made to propagate along the waveguide section 10 past the output port 34, whereupon bunches of electrons 48 will emerge and can be accelerated either by a grid such as shown by reference numeral 36 in FIG. 1, or an acceleration voltage +V or both applied to an output circuit, not shown.

Referring now to FIG. 4, the embodiment shown thereat comprises a multipactor device of a relatively simple construction and one comprised of multipactor input and output cavities 64 and 66 having mutually opposing apertures or ports 68 and 70 separated by a drift space region 72 defined by an interconnecting structure, shown schematically by reference numeral 74 and which is operated under vacuum. Such a structure is well known to those skilled in the art and in addition to an input port 76 and an output port 78, also includes multipactor posts 80 and 82 in the cavities 64 and 66 which are centrally located therein and in registration with the ports 68 and 70.

Whereas the multipactor input post 80 of the known prior art comprises a generally cylindrical structure whose outer surfaces are comprised of metallic material which exhibits secondary emission properties, the embodiment of the present invention shown in FIG. 4 departs from prior art practice by the inclusion of a layer 84 of semiconductor material on the top surface of a metal post member 86 which is insulated from the body of the input cavity 64 by an insulator member 88. The semiconductor material is specifically comprised of GaP coated with Cs. A negative bias potential −V is applied to the semiconductor layer 84 by a conductor 90 secured, for example, to the bottom of the post member 86 and passing through the insulator member 88 and the bottom wall of the input cavity 64. Again, as in the prior embodiments, the application of the biasing voltage to the semiconductor member 84 increases the secondary emission properties of the post 80 and thereby provides a distinct improvement in the generation of bunched electrons 91 which traverse the drift space 72 from the input cavity 64 to the output cavity 66 where an amplified version of the RF input appears at the output window 78.

The embodiment shown in FIG. 5 is substantially the same as that shown in FIG. 4 with the exception that the single layer 84 of n-type conductivity is replaced by a dual epitaxial layer combination comprising an outer n-type layer 92 and an inner p-type layer 94 and forming a "p-n" junction therebetween. A negative bias −V is applied to the p-type layer 94 through the connection of the wire 90 to the metal post member 86. Such an arrangement also enhances the secondary emission ratio which is accompanied by an overall improvement in the performance of the multipactor device.

Thus what has been shown and described is the concept of using semiconductor materials for improving the operation of a multipactor device whereby the secondary emission ratio can be controlled to initiate multipactor operation at lower input power levels.

While there has been shown and described what is at present considered to be the preferred embodiments of the invention, it is to be noted that the same has been made by way of illustration and not limitation. Accordingly, all other modifications, alterations and changes coming within the spirit and scope of the invention as set forth in the appended claims are herein meant to be included.

I claim:

1. A multipactor electronic device, comprising:

multipactor means including an input means, an output means, and an intermediate region of secondary electron emission comprised of at least one layer of n-type semiconductor material having a relatively high secondary emission ratio, said n-type semiconductor material being comprised of gallium phosphide with a layer of cesium;

means coupled to said region of semiconductor material for biasing said material to cause free electrons to accumulate at the surface thereof;

means for coupling an alternating RF input field to said input means for causing said free electrons to form bunches at said onput means; and means for causing said bunches to be emitted from said output means to an output circuit.

2. A multipactor electronic device, comprising:

multipactor means including an input means, an output means, and an intermediate region of secondary electron emission comprised of at least one pair of epitaxial layers of semiconductor material, said pair of epitaxial layers including an inner layer of p-type semiconductor material and an outer layer of n-type semiconductor material, said outer n-type semiconductor layer having a secondary emission ratio of 50 or more and being comprised of gallium phosphide covered with cesium;

means coupled to said region of semiconductor material for biasing said material to cause free electrons to accumulate at the surface thereof;

means for coupling an alternating RF input field to said input means for causing said free electrons to form bunches at said output means; and means for causing said bunches to be emitted from said output means to an output circuit.

3. A multipactor electronic device, comprising:

multipactor means including an input means, an output means, an intermediate region of secondary electron emission comprised of semiconductor material having a relatively high secondary emission ratio and semiconductivity type located along the length of said region, and a length of RF transmission line, said RF transmission line comprising a length of rectangular waveguide having pairs of mutually opposing walls, said region of semiconductor material comprising respective layers of semiconductor material having the same type semiconductivity located on the inner surface of one pair of said pairs of opposing walls, and said output means comprises a port located toward one end of said length of waveguide through one of said opposing walls and its adjoining layer of semiconductor material;

means coupled to said region of semiconductor material for biasing said material to cause free electrons to accumulate at the surface thereof;

means for coupling an alternating RF input field to said input means for causing said free electrons to form bunches at said output means; and means for causing said bunches to be emitted from said output means to an output circuit.

4. The multipactor device as defined by claim 3 wherein said layers of semiconductor material are comprised of n-type semiconductor material having a relatively high secondary emission ratio.

5. The multipactor device as defined by claim 4 and wherein said output means comprises a port located at the other end of said length of waveguide and additionally including means at said other end of said waveguide in the vicinity of said output port for attracting said free electrons.

6. A multipactor electronic device, comprising:

multipactor means including an input means, an output means, an intermediate region of secondary electron emission comprised of semiconductor material having a relatively high secondary emission ratio and semiconductivity type locted along the length of said region, and a length of RF transmission line, said length of RF transmission line comprising a section of waveguide having pairs of mutually opposing walls and said region of semiconductor material comprising a respective pair of epitaxial layers of mutually opposite type semiconductor material located on the inner surface of one pair of opposing walls;

means coupled to said region of semiconductor material for biasing said material to cause free electrons to accumulate at the surface thereof;

means for coupling an alternating RF input field to said input means for causing said free electrons to form bunches at said output means; and means for causing said bunches to be emitted from said output means to an output circuit.

7. The multipactor device as defined by claim 6 wherein said pair of epitaxial layers include an inner layer of p-type semiconductor material and an outer layer of n-type semiconductor material.

* * * * *